US005927582A

United States Patent [19]

Duecker

[11] Patent Number: 5,927,582

[45] Date of Patent: Jul. 27, 1999

[54] SEPARATOR FOR STACKED CORRUGATED BOARD

[76] Inventor: Peter Duecker, Ernst-Tellering-Strasse 13, Langenfeld, Germany, 40764

[21] Appl. No.: 08/906,614

[22] Filed: Aug. 5, 1997

[51] Int. Cl.[6] ..... B26F 3/02

[52] U.S. Cl. ..... 225/2; 225/96.5

[58] Field of Search ..... 225/1, 2, 96.5, 225/100, 101, 103, 105

[56] References Cited

U.S. PATENT DOCUMENTS

| | | | |
|---|---|---|---|
| 3,122,292 | 2/1964 | Ford et al. | 225/105 |
| 3,286,893 | 11/1966 | Zellers, Jr. | 225/96.5 |
| 3,372,847 | 3/1968 | Walters et al. | 225/96.5 |
| 3,517,869 | 6/1970 | Dryon | 225/2 |
| 3,592,370 | 7/1971 | Boardman | 225/2 |
| 4,041,847 | 8/1977 | Spengler | 93/36 |
| 4,088,255 | 5/1978 | DeTorre | 225/98 |
| 4,136,604 | 1/1979 | Schmidt | 93/36 |
| 4,140,258 | 2/1979 | Gray | 225/79 |
| 4,371,103 | 2/1983 | Siemens et al. | 225/2 |
| 4,500,022 | 2/1985 | Lucas | 225/97 |
| 4,646,955 | 3/1987 | Garrick et al. | 225/3 |
| 4,742,945 | 5/1988 | Garrick et al. | 225/3 |
| 4,815,644 | 3/1989 | Garrick et al. | 225/97 |
| 4,987,723 | 1/1991 | Diemer | 53/399 |
| 4,988,027 | 1/1991 | Bremmer | 225/2 |
| 5,069,195 | 12/1991 | Barozzi | 225/96.5 |
| 5,297,710 | 3/1994 | Juras | 225/96.5 |
| 5,297,711 | 3/1994 | Kogan | 225/98 |

*Primary Examiner*—Rinaldi I. Rada
*Assistant Examiner*—Gyounghyun Bae
*Attorney, Agent, or Firm*—Philip Summa, Patent Attorney

[57] ABSTRACT

The invention is a method and apparatus for separating by a pivoting motion a stack formed of a plurality of layers of die cut corrugated board and thereafter delivering separated portions of the stack while minimizing damage to the respective portions. The apparatus comprises a conveyor for delivering stacked portions to be separated, a means for securing portions of the stacked board to portions of the conveyor, and a means for pivoting a portion of the conveyor and a secured stacked portion of the board thereon to thereby pivotally separate the stacked portions from one another along a connecting thin paper web. The method comprises advancing a first and second stacked portion to be separated to a position beneath a securing means, securing the first and second stacked portions by a first and second press device, pivoting the second conveyor portion and secured second stacked portion thereon about an axis parallel to the line of thin paper web connecting the stacked portions, lowering the second conveyor portion and secured second stacked portion, and then delivering a separated stacked portion to a separate roller conveyor. The method for separating requires less force than conventional separators and thereby advantageously reduces damage caused to the top layer of the stacked portions of board.

27 Claims, 3 Drawing Sheets

SEPARATOR FOR STACKED CORRUGATED BOARD

FIELD OF THE INVENTION

The invention relates to an apparatus for separating and delivering portions of a stack formed of a plurality of layers of die cut corrugated board, and in particular relates to an apparatus and method for consecutively separating each board layer along the connecting thin paper web by a pivoting motion.

BACKGROUND OF THE INVENTION

A common material currently used in the packaging industry is corrugated paper products typically referred to as corrugated cardboard or simply "cardboard." In one basic form, the corrugated board is comprised of two layers of flat paper between which is inlaid a layer of corrugated or "fluted" paper. The resulting product is a composite laminated structure which is far sturdier than the materials from which it is formed.

In some typical applications, the boards which eventually form rectangular boxes are manufactured as flat pairs of board portions held together by a thin paper web. It is common practice to form the thin paper web by subjecting the boards to a cutting or scoring operation. After the die cutting operation, the board pairs remain mutually attached in sheets by the thin web connecting each portion of the board. The sheets of corrugated board are then conventionally stacked in quantities of up to one hundred or more. Eventually, however, the stacked portions have to be separated so that individual sheets can be folded to form individual boxes.

Conventional separators employ a conveying system which delivers the stacked paired boards to a press device. Upon delivery to the press device, a conventional separator then applies separate forces perpendicular to the plane of the stacked pairs to each respective portion of the stacked die cut boards wherein each respective press is positioned directly above each respective half of the stacked pairs. The stacked pairs are separated along the thin paper web connecting each portion when one press secures one half of the stacked pairs in a stationary position and the other press moves in a direction parallel to the underlying conveying rollers or belts.

As an alternative to the above-described pulling method for separation, conventional systems also utilize vibratory forces created by the rapid shifting of counterplate assemblies securing one portion of the stacked pairs away from the other portion secured by a separate press means. The amount of force, however, necessary to hold one half of the stacked pairs stationary while simultaneously shifting away from or pulling against every web in the stack in the other half tends to tear and damage the stacked boards.

It is also known in the industry to use pneumatically operated, hand held chisels or wedging tools to separate the boards along the thin paper web connecting the stacked portions. However, these methods tend to damage an unacceptable number of boards. Further, it is known to use cutting blades to separate the stacked pairs along the thin paper web; however, this method is labor intensive as it requires constant monitoring and adjustment.

OBJECT AND SUMMARY OF THE INVENTION

Therefore, it is an object of the present invention to provide a separating and delivery method that reduces the damage to the stacked boards caused by conventional separating methods. Therefore, the invention comprises a separating and delivery apparatus for separating portions of stacked die cut corrugated board wherein each stacked portion is connected to a respective board by a thin paper web while avoiding damage to the respective portions.

A method for separating the stacked portions of board into two stacks includes securing the stacked portions onto conveyor portions and pivoting the conveyor portions along an axis parallel to the die cuts which are aligned between the conveyor portions. The pulling force caused by the pivoting action initiates breakage along the thin web connecting each portion at the bottom of the stacked pairs which continues upwards until all the stacked pairs are separated consecutively into individual pieces of board. Because the pivoting action effectively tears the thin die cut webs one by one, the separator requires less force applied than the force required in the conventional separators described above. The stacked pairs of board are then discharged from the apparatus for delivery to the desired form of transportation.

The foregoing and other advantages and features of the invention and the manner in which the same are accomplished will become more readily apparent upon consideration of the following detailed description of the invention taken into conjunction with the accompanying drawings, which illustrate preferred an exemplary embodiments, and wherein:

DETAILED DESCRIPTION OF THE PREFERRED EMBODIMENTS

The present invention will now be described more fully hereinafter with reference to the accompanying drawings, in which a preferred embodiment of the invention is shown. This invention may, however, be embodied in many different forms and should not be construed as limited to the embodiments set forth herein; rather, this embodiment is provided so that this disclosure will be thorough and complete and will fully convey the scope of the invention to those skilled in the art. Like numbers refer to like elements throughout.

Figure 1:
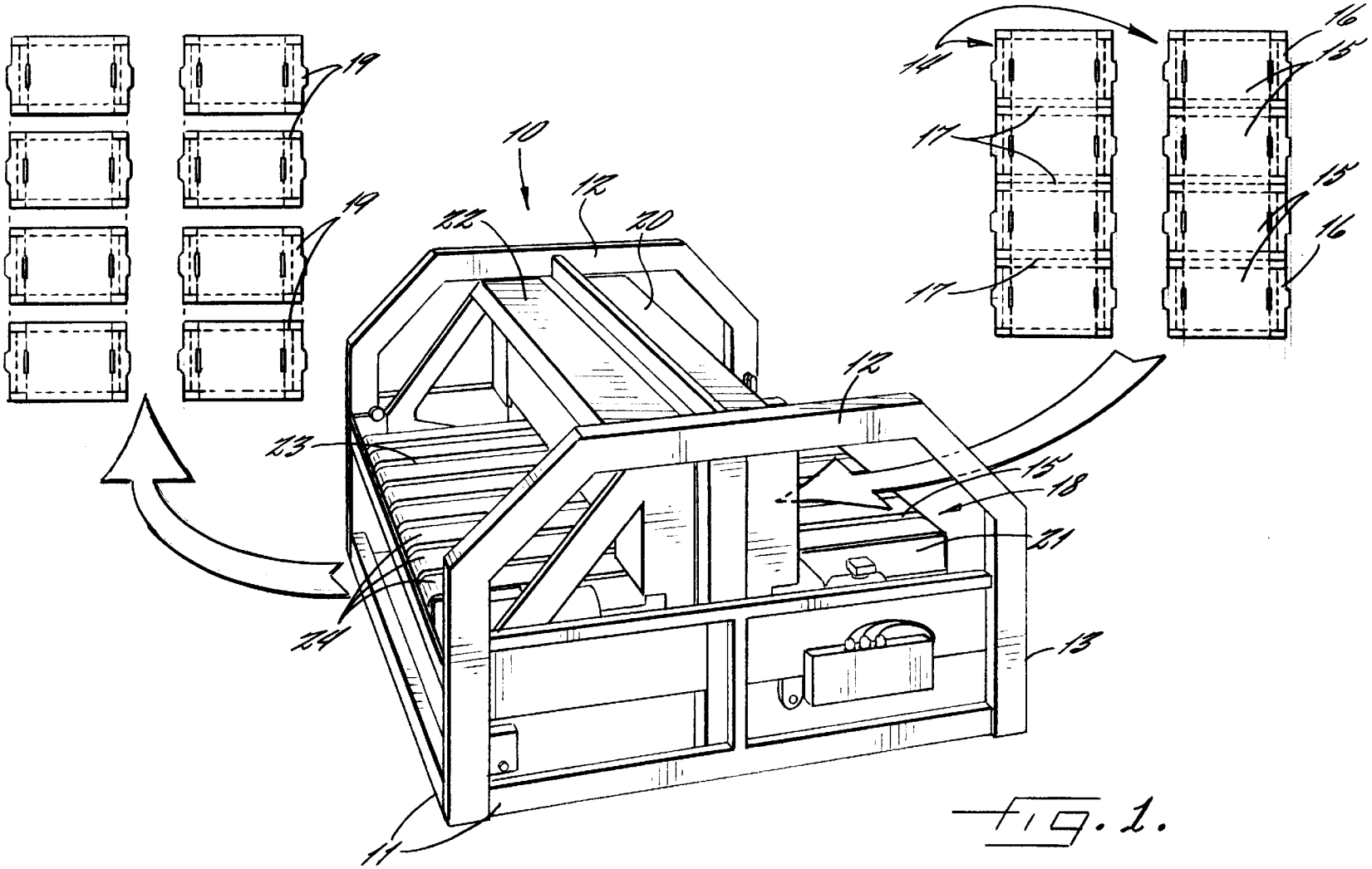
FIG. 1 is a perspective view of the invention showing the direction of advancement for stacked pairs of corrugated board.

An overall view of the separator 10 which incorporates features of the present invention is set forth in FIG. 1. As used herein, the designation "corrugated board" refers to two layers of flat paper between which is inlaid a layer of corrugated or "fluted" paper, commonly referred to as cardboard.

As illustrated in FIG. 1, the separator 10 is comprised of horizontal base rails 11 and opposing side frames 12 forming a frame structure 13. The separator 10 receives stacked die cut corrugated boards 14 wherein each board 15 in each stacked portion 16 is connected to a respective board in the other stacked portion by a thin paper web 17. The stacked boards 14 are advanced along a transport path defined by a conveyor 18 for separation and eventual discharge from the separator 10 in the form of separated stacked portions 19. The separator 10 is preferably formed from metal or similar hardened material having sufficient strength to withstand the forces generated by the pivoting means 30 as depicted in FIG. 2.

A transverse stationary frame 20 supports a first conveyor portion 21 and a transverse pivoting frame 22 supports a second conveyor portion 23. The stacked portions 16 are advanced through the separator 10 along the conveyor 18 comprised of a plurality of belts 24 positioned horizontally to and longitudinally along the transport path. The belts 24 are supported by multiple rollers 25 forming part of the advancement means for advancing stacked portions 16 along the transport path and located at opposing ends of the first and second conveyor portions 21, 23 as shown in FIG. 2.

Figure 2:
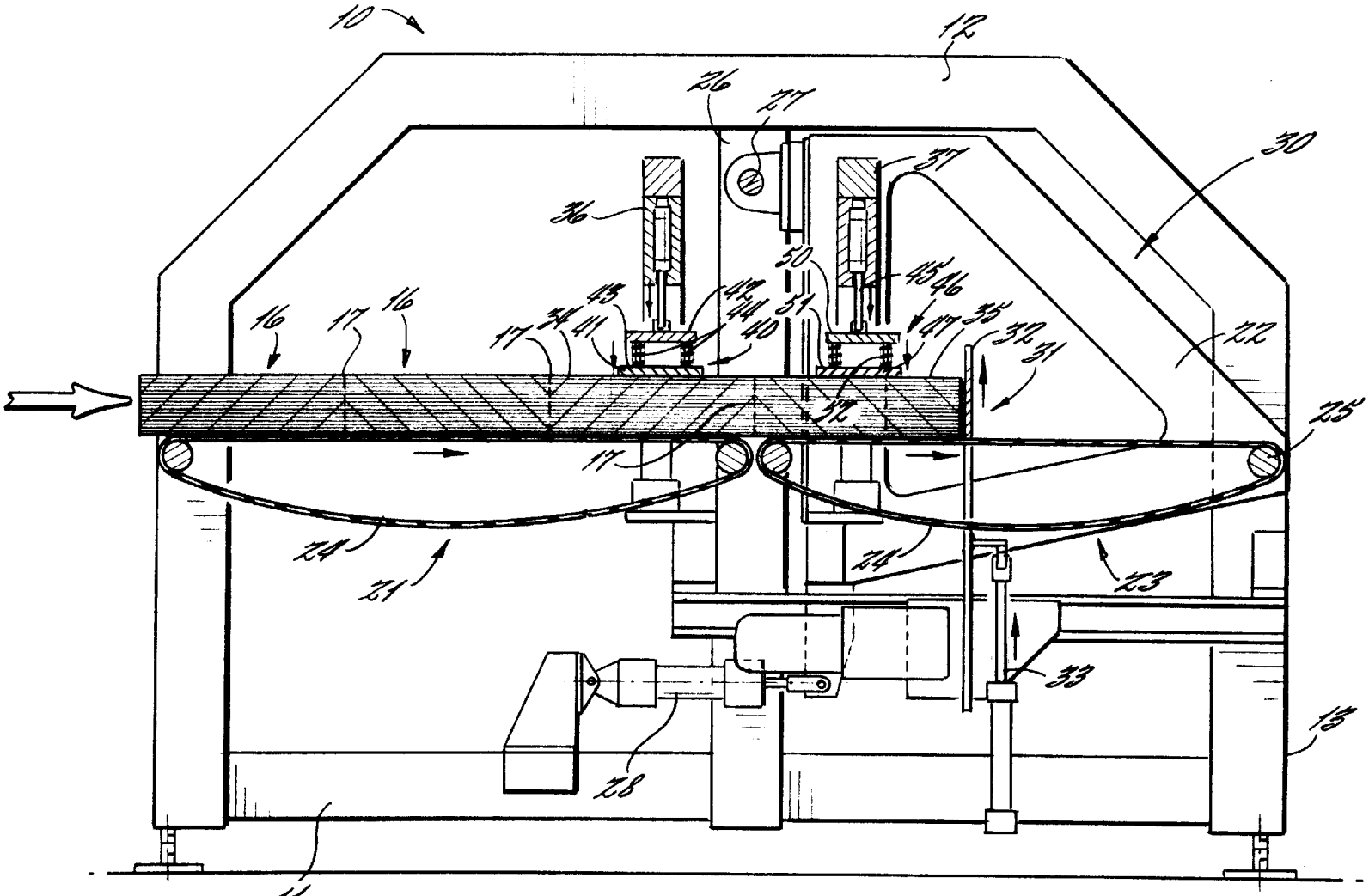
FIG. 2 is a cross-sectional side view of the invention showing the stacked pairs advanced along a transport path to a position wherein first and second press devices secure a first and second portion of the stacked pairs.

As illustrated in FIG. 2, the multiple rollers 25 are secured to the transverse stationary frame 20 and transverse pivoting frame 22 and positioned perpendicular to the transport path. As part of the advancement means, rotation of the multiple rollers 25 causes the belts 24 to advance the stacked portions 16 along the transport path. The first conveyor portion 21 secured to the transverse stationary frame 20 receives the initial stacked portions 16 when the advancing means is activated. The second conveyor portion 23 secured to the transverse pivoting frame 22 forms part of the pivoting means 30. The pivoting means 30 is secured to a vertical beam 26 forming part of the frame structure 13 at pivot point 27. A piston 28 for pivoting the pivoting means 30 is attached to a lower portion of horizontal base rails 11 forming part of the separator 10.

The separator 10 also includes an aligning means comprised of a vertically reciprocating front stop 31 for halting the advancement of the stacked portions 16. The front stop 31 is positioned perpendicular to the transport path defined by the second conveyor portion 23. A plurality of arms 32 (not shown) forming the vertically reciprocating front stop 31 is positioned vertically and spaced complimentary to the position and spacing of the belts 24 comprising the second conveyor portion 23. The front stop 31 is attached to a piston 33 secured to a lower portion of the frame structure 13 forming the separator 10. In this configuration, the vertical arms 32 can be reciprocated into the transport path, thereby stopping the forward progress of the stacked portions 16 along the transport path and aligning a first and second stacked portions 34, 35 directly beneath a securing means. The securing means comprises a first and second press device 36, 37 supported by the stationary frame 20 and pivoting frame 22 respectively.

The first and second press devices 36, 37 secure the stacked portions 16 on the first and second conveyor portions 21, 23 prior to separation. The first press device 36 includes a piston 38, a plate assembly 40, and a contact surface 41 which acts upon the top layer of the first stacked portion 34. The plate assembly 40 comprises two opposing plates 42, 43 attached to one another by springs 44. The piston 38 for reciprocating the plate assembly 40 is secured to the stationary frame 20 supporting the first conveyor portion 21 forming a part the separator.

The second press device 37 includes a piston 45, a plate assembly 46, and a contact surface 47 which acts upon the top layer of the second stacked portion 35. The plate assembly 46 comprises two opposing plates 50, 51 attached to one another by springs 52. The piston 45 is secured to the pivoting means 30 supporting the second conveyor portion 23 which forms a part of the separator 10. In particular, such a configuration provides a force perpendicular to the transport path which is sufficient to secure the first and stacked portions 34, 35, while avoiding damaging the stacked portions 16.

It will be further understood that the invention comprises the method of separating stacked portions 16 of corrugated board advanced along the transport path into separated portions 19. The method comprises advancing stacked portions 16 along a transport path, securing the stacked portion 16 to the conveyor portions 21, 23, and pivoting the conveyor portions with respect to one another along an axis parallel to the die cuts 17 thereby separating the stacked portions 16 into separated portions 19 for eventual transport.

Figure 3:
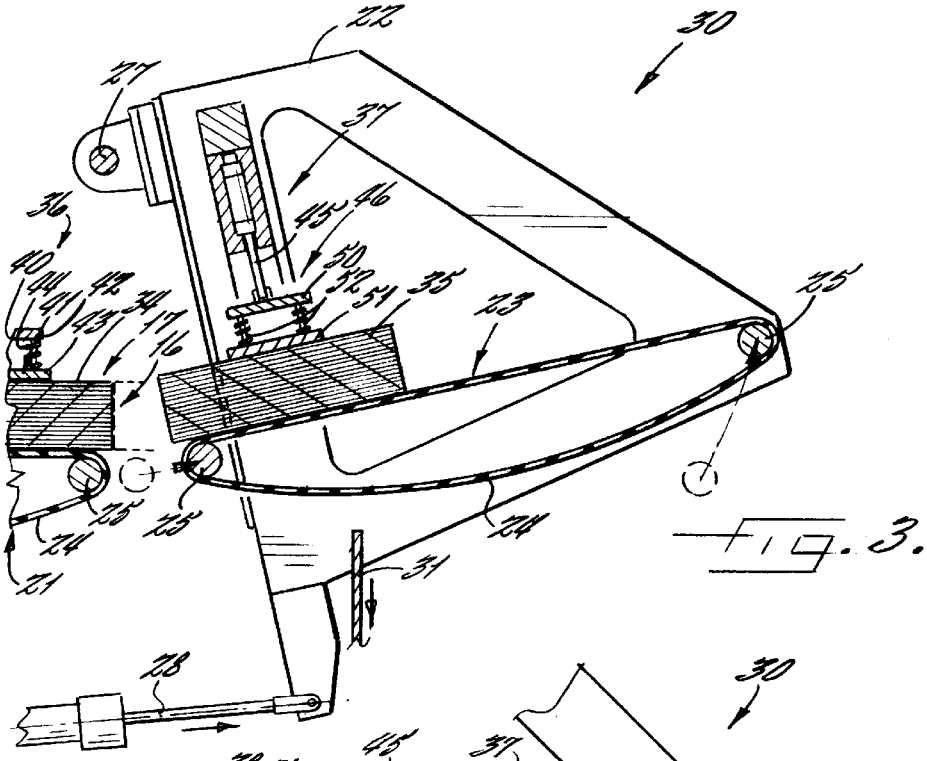
FIG. 3 is a cross-sectional view of a pivoting means and in particular showing a piston pivoting the second press device and the second portion of the conveyor.
Figure 4:
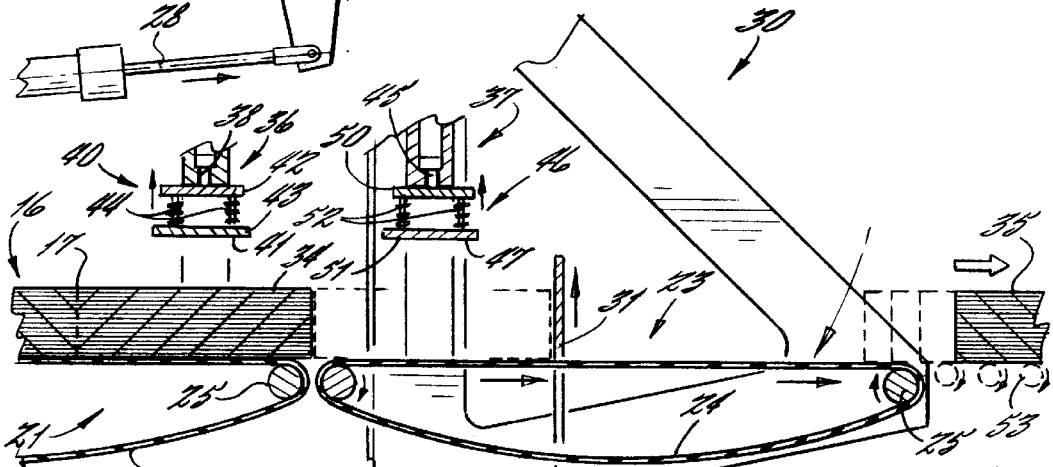
FIG. 4 is a cross-sectional view of the pivoting means in a lowered position after separating the stacked pairs showing the second portion of the stacked pairs being discharged from the pivoting means.
Figure 5:
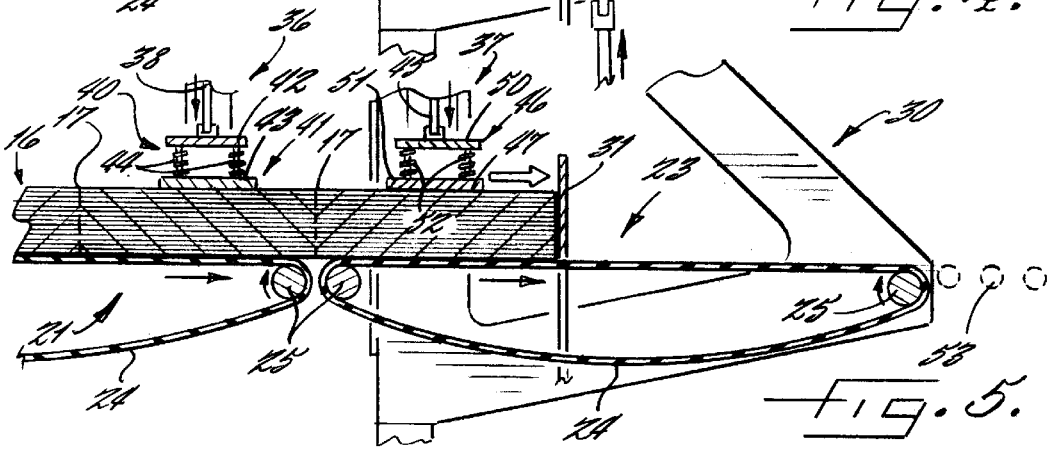
FIG. 5 is a cross-sectional view of the pivoting means showing an alignment means in a raised position and the advancement of the stacked pairs along the conveyor into a position beneath the press devices for separating the portions of stacked pairs.

FIGS. 3–5 illustrate the pivoting means 30 and its ability to pivot the second conveyor portion 23 and the second press device 37 along an axis parallel to the die cuts 17 on the stacked portions 16. The die cuts 17 are aligned between the first and second conveyor portions 21, 23 by the vertically reciprocating front stop 31. As shown in FIG. 3, the pulling force caused by the pivoting action of the pivoting means 30 initiates breakage along the thin web 17 connecting each portion 15 at the bottom of the stacked portions 16. The breakage continues upwards until all of the stacked portions 16 are separated consecutively into separated portion 19.

As shown in FIG. 3, the stacked portions 16 are advanced along the conveyor 18 and the front stop 31 is reciprocated into the conveyor path, thereby halting the first and second stacked portions 34, 35 at a position directly beneath the first and second press devices 36, 37. Next, the press devices 36, 37 engage and secure the first and second stacked portions 34, 35 on the first and second conveyor portions 21, 23 respectively. The front stop 31 is then reciprocated out of the transport path. The pivoting means 30 including the second conveyor portion 23 and secured second portion 35 are rotated about a pivot point 27 upwards and away from the first conveyor portion 21 by the piston 28, thereby separating the first and second portions 34, 35 of the stacked board 14 from one another.

As depicted in FIG. 4, the pivoting means 30 and separated second portion 35 thereon are subsequently lowered and the first and second press devices 36, 37 disengage thereby releasing the stacked portions 34, 35 from a secured position. Next, the stacked portions 34, 35 are advanced along the first and second conveyor portions 21, 23 respectively. The first stacked portion 34 and adjacent portions 16 connected by the thin paper web 17 advance along the first conveyor portion 21 until forward progress is halted by the front stop 31 which is reciprocated into the transport path. The front stop 31 thereby aligns the advancing stacked portions directly beneath the first and second press devices 36, 37. The separated second stacked portion 35 advances along the second conveyor portion 23, exits the pivoting means 30, and is discharged onto a separate roller conveyor 53.

FIG. 5 shows succeeding stacked portions 16 advancing along the first and second conveyor portions 21, 23 and the front stop 31 aligning the portions 16 beneath the press devices 36, 37. The first and second press devices 36, 37 are then lowered to engage the top layer of the stacked portions 16 and secure the stacked portions to the first and second portions of the conveyor 21, 23. The steps of pivoting, separating, and delivering are repeated for any number of items.

In the drawings and the specification, there has been set forth a preferred embodiment of the invention and, although specific terms are employed, the terms are used in a generic and descriptive sense only and not for purpose of limitation, the scope of the invention being set forth in the following claims.

That which is claimed is:

1. An apparatus for separating and delivering first and second portions of a stack formed of a plurality of layers of die cut corrugated board in which each board in each stacked portion is connected to a respective board in the other stacked portion by a thin paper web forming a part of the liner of the board, while avoiding damaging the respective portions, said apparatus comprising:

a conveyor comprising a first and second portion;

means for securing a first portion of a connected stack of a plurality of aligned die cut corrugated boards in a stationary position on a first portion of said conveyor;

means for securing a second portion of the connected stack of die cut corrugated boards in a stationary position on a second portion of said conveyor, with the aligned thin paper webs positioned between said first and second conveyor portions; and means for pivoting the second portion of said conveyor and the secured second stacked portion of the die cut corrugated boards thereon about an axis parallel to the line of the aligned thin paper webs between the first and second portions while the second stacked portion of the die cut corrugated boards remains secured on said second portion of said conveyor to thereby pivotally separate the first and second stacked portions of the die cut corrugated boards from one another by consecutively pivotally separating each board layer along its respective connecting thin paper web.

2. A separating and delivering apparatus according to claim 1 wherein said conveyor comprises a plurality of belts positioned horizontally to and longitudinally along a transport path.

3. A separating and delivering apparatus according to claim 1 wherein said respective first and second portions of said conveyor comprise a means for advancing said respective first and second connected stack of die cut corrugated boards along a transport path.

4. A separating and delivering apparatus according to claim 3 wherein said advancing means further comprises means for aligning said first and second connected stack of die cut corrugated boards directly beneath said first and second securing means.

5. A separating and delivering apparatus according to claim 4 wherein said aligning means further comprises a vertically reciprocating front stop perpendicular to said second conveyor portion for halting said respective first and second connected stack of die cut corrugated boards at a position directly beneath said first and second securing means.

6. A separating and delivering apparatus according to claim 5 wherein said front stop comprises a plurality of arms positioned vertically and spaced complementary to the position and spacing of said belts of said second conveyor portion so that said plurality of arms can be reciprocated into said transport path so that said arms can stop the forward progress of said connected stack of die cut corrugated boards along said transport path.

7. A separating and delivering apparatus according to claim 1 wherein said first means for securing said first portion of said connected stack of die cut corrugated boards further comprises a first press device for applying a force perpendicular to the transport path.

8. A separating and delivering apparatus according to claim 7 wherein said first press device further comprises a contact surface which acts upon the top layer of said first portion of said connected stack of die cut corrugated boards while avoiding damaging the stacked layer.

9. A separating and delivering apparatus according to claim 1 wherein said second means for securing said second portion of said connected stack of die cut corrugated boards further comprises a second press device for applying a force perpendicular to the transport path.

10. A separating and delivering apparatus according to claim 9 wherein said second press device further comprises a contact surface which acts upon the top layer of said second portion of said connected stack of die cut corrugated boards while avoiding damaging the stacked layer.

11. A separating and delivering apparatus according to claim 1 wherein said pivoting means comprises a piston having one end secured to the base frame and an opposite end secured to said pivoting means for pivoting said secured second portion of said connected stack of die cut corrugated boards about the axis parallel to the line of the thin paper web between the first and second portions of said connected stack of the die cut corrugated board.

12. A separating and delivering apparatus according to claim 1 and further comprises a supply of stacked corrugated board.

13. A method for separating a single stack into two separate stacks in which the stack to be separated is formed of a plurality of aligned die cut corrugated boards in which each board in each stack is connected to a respective board in the other stack by a thin paper web forming part of the liner of the board corresponding to the die cut, while avoiding damaging the original stack or the resulting stacks, the method comprising:

securing the stack on two respective conveyor portions with the die cuts in the connected stack aligned between the conveyor portions; and pivoting the conveyor portions with respect to one another along an axis parallel to the die cuts to thereby pivotally separate the connected stack into first and second portions by consecutively separating each board layer along its respective die cut.

14. A method for separating a stack into two stacks in which the stack to be separated is formed of a plurality of aligned die cut corrugated boards in which each board in each stack is connected to a respective board in the other stack by a thin paper web forming part of the liner of the board corresponding to the die cut, while avoiding damaging the original stack or the resulting stacks, the method comprising:

pivoting two respective conveyor portions, upon which the connected stack of aligned die cut corrugated boards has been secured with the respective die cuts aligned between the conveyor portions, along an axis parallel to the die cuts to thereby pivotally separate the connected stack into first and second portions by consecutively separating each board layer along its respective die cut.

15. A separating method according to claim 14 and further comprising the step of engaging a front stop along the portion of the transport path at a position on the second conveyor.

16. A separating method according to claim 14 and further comprising the step of engaging a plurality of arms of the front stop along the transport path.

17. A separating method according to claim 14 and further comprising the step of advancing the stack of aligned die cut corrugated boards along the conveyor portions until the respective die cuts in the stack are aligned between the conveyor portions.

18. A separating method according to claim 14 and further comprising the step of securing the stack of aligned die cut corrugated boards to the respective conveyor portions prior to the step of pivoting the conveyor portions.

19. A separating method according to claim 14 and further comprising the step of pivoting the second conveyor portion upon which the second stack has been secured and the second press device securing the second stack, in an upward position along an axis parallel to the die cuts, to a predetermined position sufficient to pivotally separate the first and second secured stacks along said die cut.

20. A separating method according to claim 14 and further comprising the step of pivoting the second conveyor portion upon which the second stack has been secured and the second press device securing the second stack, in a downward position along an axis parallel to the die cuts.

21. A method for consecutively separating first and second portions of a connected stack of a plurality of aligned die cut corrugated boards in which each board in each stacked portion is connected to a respective board in the other stacked portion by a thin paper web forming part of the liner of the board corresponding to the die cuts, while avoiding damaging the respective portions, the method comprising:

pivoting two respective conveyor portions, upon which the connected stack of aligned die cut corrugated boards has been secured with the respective die cuts aligned between the conveyor portions, along an axis parallel to the die cuts to thereby pivotally separate the stack of aligned die cut corrugated boards along its respective die cuts.

22. A separating method according to claim 21 and further comprising the step of engaging a front stop along the portion of the transport path at a position on the second conveyor.

23. A separating method according to claim 21 and further comprising the step of engaging a plurality of arms of the front stop along the transport path.

24. A separating method according to claim 21 and further comprising the step of advancing the stack of aligned die cut corrugated boards along the conveyor portions until the respective die cuts in the stack are aligned between the conveyor portions.

25. A separating method according to claim 21 and further comprising the step of securing the stack of die cut corrugated boards to the respective conveyor portions prior to the step of pivoting the conveyor portions.

26. A separating method according to claim 21 and further comprising the step of pivoting the second conveyor portion upon which the second portion of the connected stack of aligned die cut corrugated boards has been secured and the second press device securing the second portion of the stacked boards, in an upward position along an axis parallel to the die cuts, to a predetermined position sufficient to pivotally separate the first and second portions of stacked boards along the die cuts.

27. A separating method according to claim 21 and further comprising the step of pivoting the second conveyor portion upon which the second portion of the stacked boards has been secured and the second press device securing the second portion of the stacked boards, in a downward position along an axis parallel to the die cuts.

* * * * *